US005740822A

United States Patent [19]

Einck

[11] Patent Number: 5,740,822

[45] Date of Patent: Apr. 21, 1998

[54] PATIO SET

[75] Inventor: Barry Einck, Huntington Beach, Calif.

[73] Assignee: Esign Design Inc., Huntington Beach, Calif.

[21] Appl. No.: 784,690

[22] Filed: Jan. 15, 1997

[51] Int. Cl.[6] ..... E04H 15/02

[52] U.S. Cl. ..... 135/16; 135/98; 135/96; 135/99; 135/20.3; 135/21; 135/25.1; 135/33.2

[58] Field of Search ..... 135/15.1, 16, 20.1, 135/20.3, 21, 25.1, 25.33, 26, 28, 30, 19.5, 33.2, 37, 38, 39, 98, 90, 96, 99, 22

[56] References Cited

U.S. PATENT DOCUMENTS

| | | | |
|---|---|---|---|
| 209,772 | 11/1878 | Nisbet et al. | 135/99 X |
| 244,058 | 7/1881 | Hoek | 135/99 X |
| 534,058 | 2/1895 | Ackermann et al. | 135/20.3 |
| 574,091 | 1/1896 | Irvine, Jr. | 135/33.2 X |
| 645,704 | 3/1900 | Downs | 135/98 |
| 1,936,428 | 11/1933 | Friesner | 135/15.1 X |
| 3,419,024 | 12/1968 | Nickerson, Jr. | 135/98 |
| 3,477,453 | 11/1969 | D'Ulisse et al. | 135/98 X |
| 3,875,952 | 4/1975 | Black | 135/99 X |
| 3,899,168 | 8/1975 | Besherse | 135/99 X |
| 3,910,631 | 10/1975 | Inaba | 135/16 X |
| 4,422,468 | 12/1983 | Wilson | 135/98 X |
| 4,637,415 | 1/1987 | Dalo et al. | 135/98 |
| 5,172,712 | 12/1992 | Robinson | 135/98 |

*Primary Examiner*—Wynn E. Wood
*Attorney, Agent, or Firm*—Michael, Best & Friedrich LLP

[57] ABSTRACT

A patio set including having a table having an upper surface and an opening in the upper surface, and an umbrella positionable within the opening in the table. The umbrella includes a shaft dimensioned to be inserted into the opening in the table, and a canopy having an upper end that is slidable relative to the shaft. Preferably, the canopy is movable between a raised position adjacent an upper end of the shaft and a lowered position adjacent a midportion of the shaft. A skirt extends down from the canopy and is movable relative to the canopy between a retracted position and an extended position. The skirt is designed to be in the retracted position when the canopy is in the raised position, thereby allowing standard use of the patio set, and is designed to be in the extended position when the canopy is in the lowered position, thereby providing substantially complete coverage to the table and chairs.

18 Claims, 4 Drawing Sheets

40
32
36
24
44
34
50
14
30
28
56
62
48
36
46
48
52
52
20
68
54
12
60
18
42
38
26
36
16

PATIO SET

FIELD OF THE INVENTION

The present invention generally relates to the field of patio equipment, and more specifically to patio umbrellas.

BACKGROUND OF THE INVENTION

It is well known to use patio umbrellas to provide users with protection from the sun and rain. Patio umbrellas typically include a canopy connected to a central shaft. The canopy commonly includes a sliding member adapted to slide along the shaft, a plurality of elongated ribs pivotally mounted to the upper end of the shaft, and a plurality of corresponding stays having one end pivotally connected to a mid-portion of a corresponding rib and the other end pivotally connected to the sliding member. A fabric cover is draped over and attached to the ribs. In operation, the sliding member can be selectively slid along the shaft to move the canopy between a collapsed position and an expanded raised position. The canopy is typically stored in the collapsed position.

SUMMARY OF THE INVENTION

The present invention is directed to an umbrella that can be moved from an expanded raised position to an expanded lowered position. In the expanded lowered position, the canopy acts as a cover for the patio table and chairs. Such covering provides protection from the wind, rain, hail and sun when the table and chairs are not in use. The protection is believed to substantially increase the useful life of the table and chairs. In addition, the covering provides a visually appealing cover for the table and chairs.

In one aspect, the present invention provides a patio set including a table having an upper surface and an opening in the upper surface, and an umbrella positionable within the opening in the table. The umbrella includes a shaft dimensioned to be inserted into the opening in the table, and a canopy having an upper end that is slidable relative to the shaft. Preferably, the canopy is movable between a raised position adjacent an upper end of the shaft and a lowered position adjacent a midportion of the shaft. By virtue of this arrangement, in addition to its typical function of providing shade to the user of the patio set (i.e., in its raised position), the canopy can also be used as a protective cover (i.e., in its lowered position) when the patio set is not in use. This feature can protect the table, chairs and cushions from the elements, thereby extending the useful life of the patio set.

The umbrella can further include means for moving the canopy relative to the shaft. For example, the moving means can include a flexible member (e.g., a cord, chain, belt, or similar item) that extends up through the shaft, around the upper end of the shaft, back toward the canopy and attached to the canopy. The flexible member can also extend out of the shaft adjacent to the lower end to allow manual manipulation of the flexible member. To facilitate smooth operation of the flexible member, pulleys can be provided at the upper and lower end of the shaft.

In another aspect, the present invention provides a patio set as generally described above, wherein the umbrella includes a skirt extending down from the canopy and movable relative to the canopy between a retracted position and an extended position. When in the extended position, the skirt will provide added protection to the patio set when not in use. When in the retracted position, the skirt is substantially out of view, thereby allowing standard use of the patio set. The skirt is preferably used in combination with the above-described movable canopy. In this combination, the skirt is designed to be in the retracted position when the canopy is in the raised position, thereby allowing standard use of the patio set, and is designed to be in the extended position when the canopy is in the lowered position, thereby providing substantially complete coverage to the table and chairs.

The umbrella can further include means for moving the skirt between the retracted and extended positions. In one embodiment, the moving means includes a plurality of flexible members connected to the skirt (e.g., the lower end of the Skirt). Preferably, the flexible members are positioned at least partially within either corresponding ribs or corresponding stays in the canopy. At the upper ends of the ribs, the flexible member can exit the ribs and extend down the outer surface of the shaft. The flexible members are then secured relative to the shaft.

DETAILED DESCRIPTION

Figure 1:
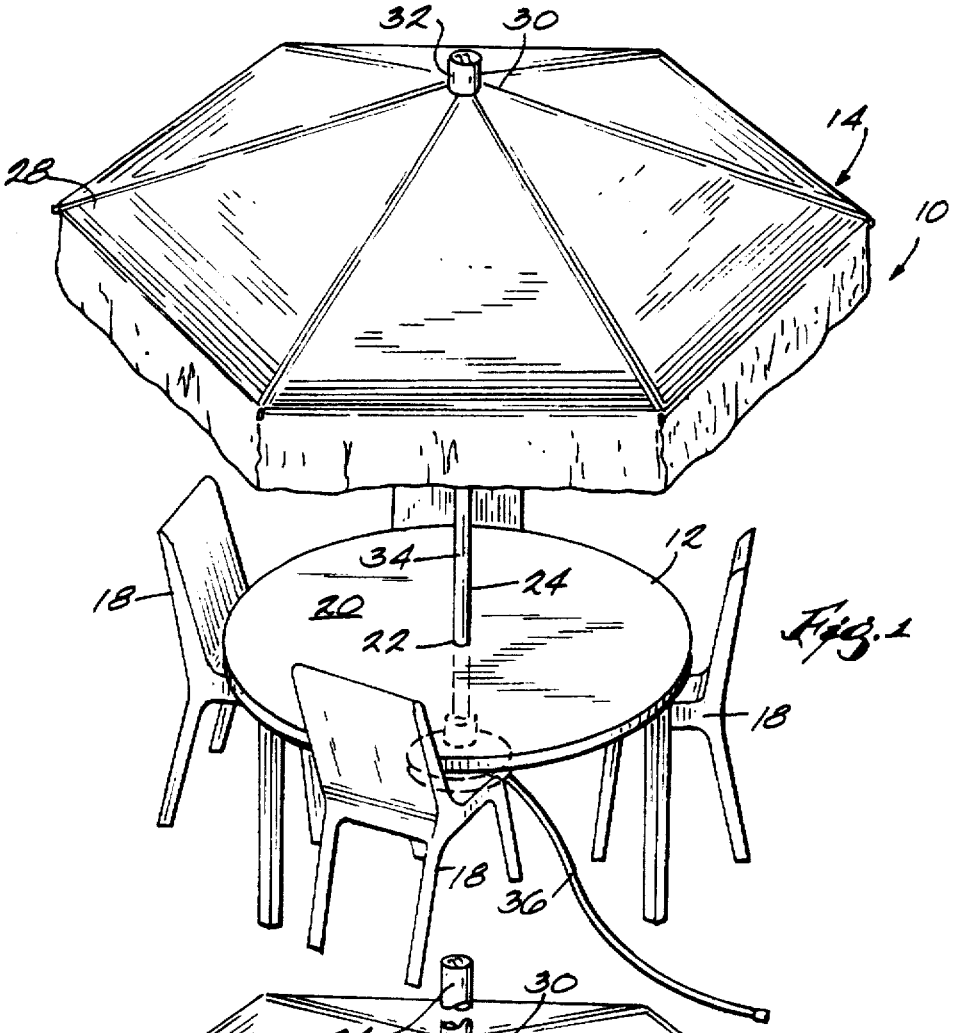
FIG. 1 is a perspective view of a patio set having an umbrella embodying the present invention, with the canopy in an expanded raised position.

The illustrated patio set 10 includes a table 12, an umbrella 14, an umbrella base 16 and several chairs 18. The table 12 includes an upper surface 20 and an opening 22 in the upper surface 20. The umbrella 14 includes a shaft 24 positioned through the opening 22 in the table 12, and a lower end 26 of the shaft 24 is mounted within the base 16.

Figure 2:
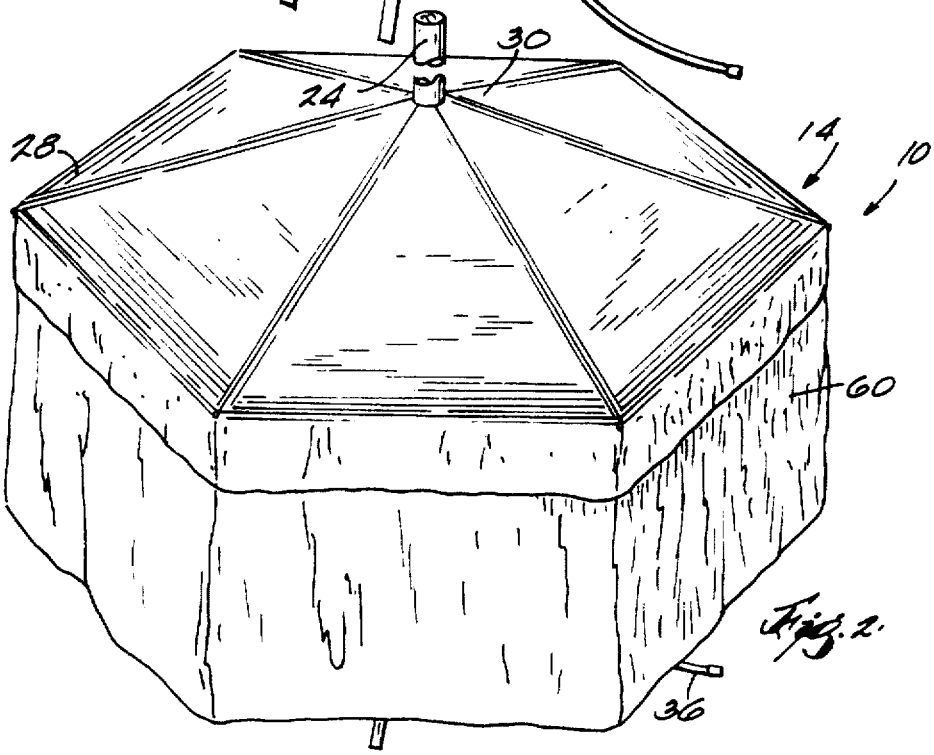
FIG. 2 is the perspective view of the patio set of FIG. 1 with the canopy in an expanded lowered position.

The umbrella 14 further includes a canopy 28 slidably mounted on the shaft 24. The canopy 28 can be moved relative to the shaft 24 between a raised position (FIG. 1) and a lowered position (FIG. 2). In the raised position, an upper end 30 of the canopy 28 is positioned adjacent to an upper end 32 of the shaft 24. In the lower position, the upper end 30 of the canopy 28 is positioned adjacent to a mid-portion 34 of the shaft 24 (i.e., between the upper end 32 and the lower end 26 of the shaft 24).

The umbrella 14 further includes means for moving the umbrella 14 relative to the shaft 24. In the illustrated embodiment, the moving means includes a first flexible member 36 extending up through the shaft 24, around the upper end 32 of the shaft 24 and back toward the canopy 28 where one end of the first flexible member 36 is attached to the canopy 28. The other end of the first flexible member 36 extends out of an opening 38 adjacent to the lower end 26 of the shaft 24, thereby allowing manual manipulation of the flexible member. An upper pulley 40 and a lower pulley 42 are provided to facilitate smooth movement of the first flexible member 36 through the shaft 24. A push-button detent member 44 is provided to hold the canopy 28 in the raised position. The detent member 44 is spring biased and is sized to fit within a hole in the canopy 28, thus securing the canopy 28 relative to the shaft 24. The detent member 44 can be pushed in toward the shaft to allow the canopy 28 to slide relative to the shaft 24.

The canopy 28 includes a sliding member 46 positioned on the shaft 24, a plurality of ribs 48 pivotally attached adjacent to an upper portion 50 of the sliding member 46, and a plurality of stays 52 pivotally interconnecting the ribs 48 with a lower portion 54 of the sliding member 46. A flexible fabric cover 56 is draped over the ribs 48.

Figure 5:
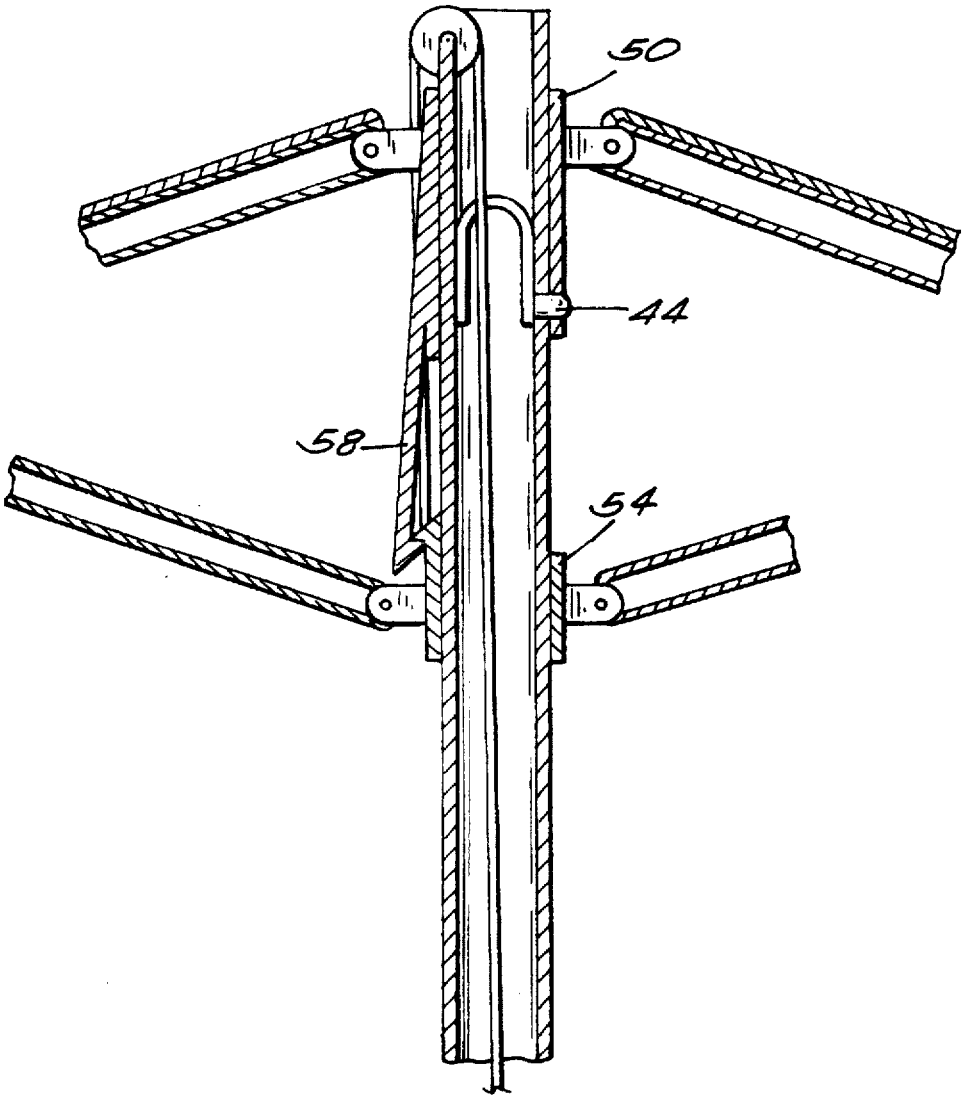
FIG. 5 is a side section view of an alternative embodiment.

In the illustrated embodiment, the upper portion 50 of the sliding member 46 is formed integrally with the lower portion 54 of the sliding member 46. Therefore, the stays 52 always move in generally the same manner as the ribs 48. It should be appreciated, however, that the lower portion 54 of the sliding member 46 could instead be designed to be detachable from the upper portion 50 of the sliding member 46, thus allowing the lower portion 54 to be moved downwardly relative to the upper portion 50 to allow collapsing of the canopy 28. In this situation, a detachable interconnecting member 58 (FIG. 5) can be provided between the upper portion 50 and the lower portion 54 so that the lower portion 54 can be locked with the canopy 28 in the expanded position. Alternatively, a detachable coupling or any other suitable mechanism can be used for this purpose.

Figure 3:
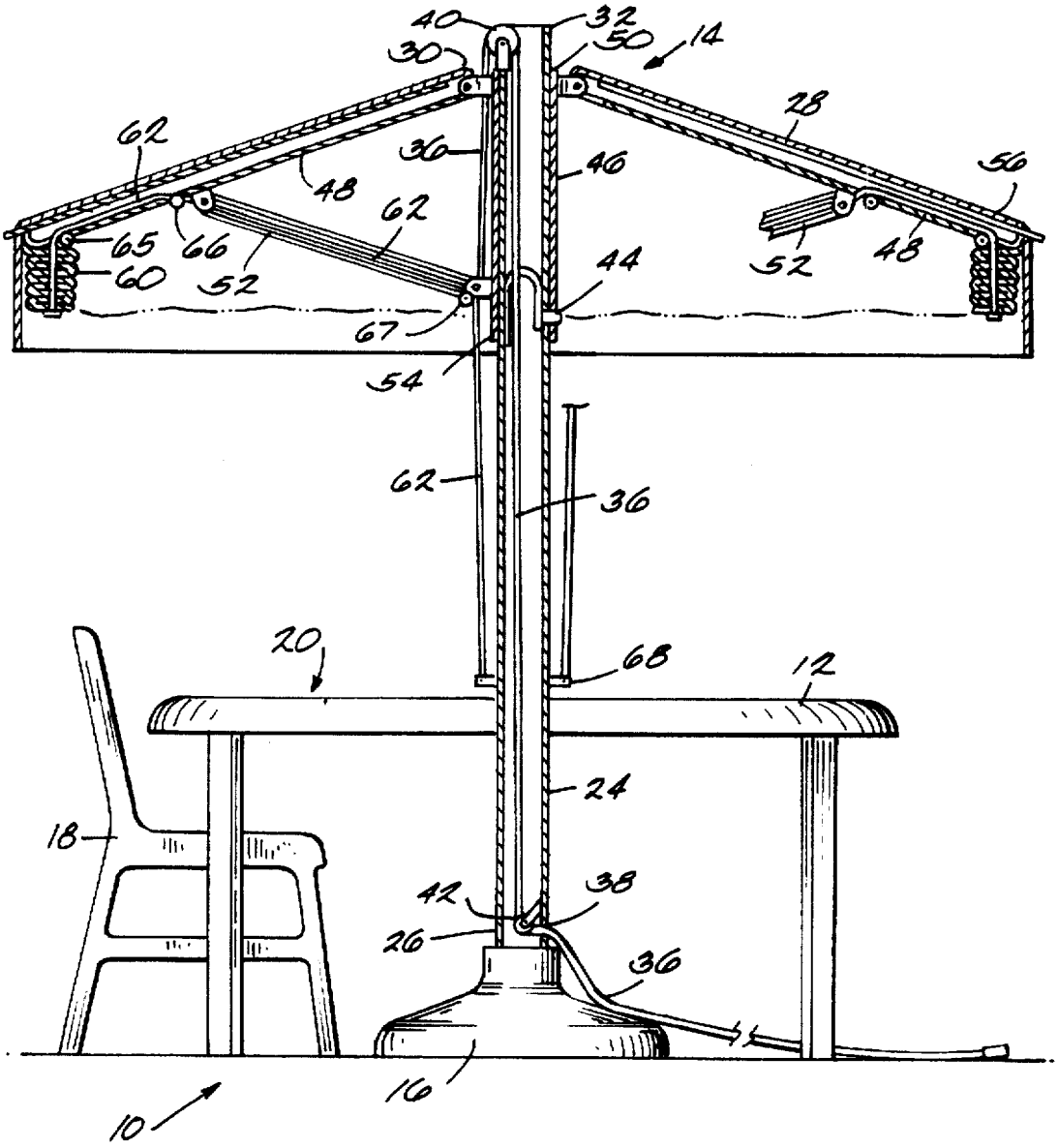
FIG. 3 is a side section view of the patio set of FIG. 1.
Figure 4:
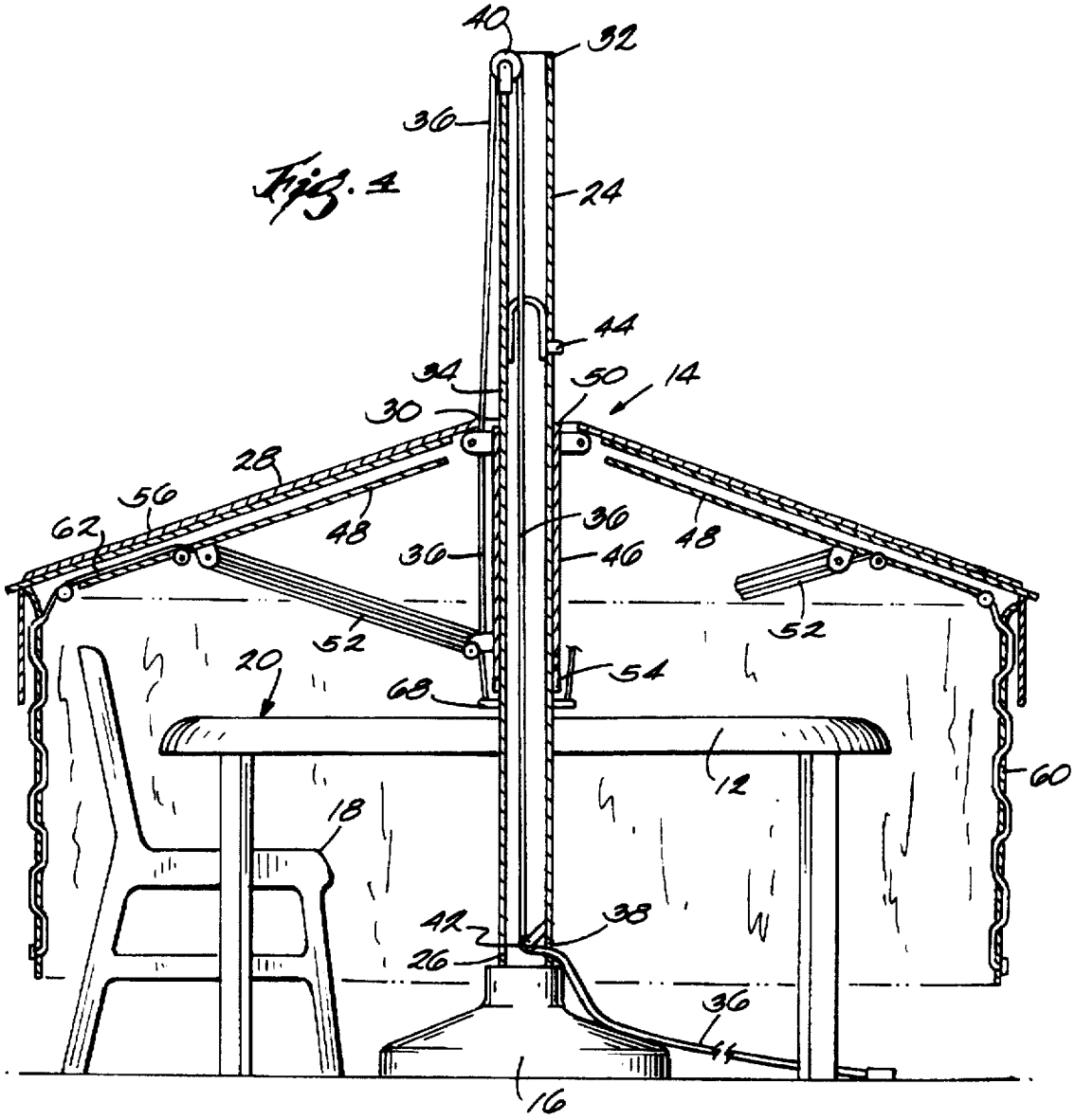
FIG. 4 is a side section view of the patio set of FIG. 2.

The umbrella 14 further includes a skirt 60 extending down from a periphery of the canopy 28. The skirt 60 is designed to be moveable relative to the canopy 28 between a retracted position (FIGS. 1 and 3) and an extended position (FIGS. 2 and 4). The umbrella 14 further includes means for moving the skirt 60 between the retracted and extended positions. In the illustrated embodiment, the moving means includes a plurality of second flexible members 62 connected to a lower end 64 of the skirt 60. The second flexible members 62 extend upwardly from the lower end of the skirt 60 and intermittently passed through the skirt 60 to maintain control of the skirt 60 and to facilitate folding as the skirt 60 is moved to the retracted position. The second flexible members 62 pass around pulleys 65, through the ribs 48 in the canopy 28, around pulleys 66 at the midportion of the ribs 48, through the stays 52, around pulleys 67, and down along the side of the shaft 24. In the illustrated embodiment, the second flexible members 62 are secured to the shaft 24 at a location 68 that is above the upper surface 20 of the table 12. It can be appreciated that, in order to enhance the visual appearance of the patio set 10, the second flexible members 62 could be recessed within longitudinal grooves (not shown) in the shaft 24. Such longitudinal grooves could also provide protection to the flexible members to prevent undesirable wear. In the illustrated embodiment, the second flexible members 62 are cords.

In operation, the canopy 28 can be moved from the raised position to the lowered position by grasping the lower end of the first flexible member 36, depressing the detent member 44, and gradually allowing the first flexible member 36 to be pulled into the opening 38 of the shaft 24. Gravity will force the canopy 28 from the raised position to the lowered position, or any position therebetween. As the canopy 28 is moved to the lowered position, the skirt 60 will automatically move from the retracted position to the extended position without additional input by the user.

It should be appreciated that the function provided by the first flexible member and pulleys could be accomplished in a variety of equivalent ways. For example, any appropriate linear actuator (e.g., rack and pinion, pneumatic cylinder, hydraulic cylinder, etc.) could be utilized to provide movement to the canopy. In addition, rather than designing the umbrella to be manually operable, the umbrella could be provided with a power actuator to move the canopy between the raised and lowered positions. For example, a motor could be used to pull the first flexible member. The motor could be chosen to also provide sufficient holding force to hold the canopy in position when the motor is deactivated.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A patio set comprising:

a table having an upper surface and an opening in said upper surface; and an umbrella positionable within said opening in said table, said umbrella comprising:

a shaft inserted into said opening in said table; and a canopy having an opening through which said shaft extends, and having an upper end that is slidable relative to said shaft from a raised position to a lowered position.

2. A patio set as claimed in claim 1, wherein said shaft includes an upper end and a midportion, wherein the raised position corresponds with said upper end of said canopy adjacent said upper end of said shaft, and wherein the lowered position corresponds with said upper end of said canopy adjacent said midportion of said shaft.

3. A patio set as claimed in claim 1, further comprising a skirt extending down from said canopy and movable relative to said canopy between a retracted position and an extended position.

4. A patio set as claimed in claim 3, wherein said skirt is in the retracted position when said canopy is in the raised position, and wherein said skirt is in the extended position when said canopy is in the lowered position.

5. A patio set comprising:

a table having an upper surface and an opening in said upper surface; and an umbrella positionable within said opening in said table, said umbrella comprising:

a shaft inserted into said opening in said table;

a canopy attached to said shaft;

a skirt extending down from said canopy and movable relative to said canopy between a retracted position and an extended position; and a moving means for moving said skirt between the retracted and extended positions.

6. A patio set as claimed in claim 5, wherein said moving means comprises a plurality of flexible members connected to said skirt to facilitate moving said skirt between the retracted position and the extended position.

7. A patio set as claimed in claim 6, wherein said canopy further includes a plurality of ribs, and wherein said flexible members are positioned at least partially within corresponding ribs.

8. An umbrella comprising:

a shaft having a longitudinal extent defining an axis;

a canopy having an upper end that is slidable relative to said shaft along the axis, said canopy being movable between collapsed and expanded positions a skirt extending down from said canopy and movable relative to said canopy between a retracted position and an extended position;

and moving means for moving said skirt between the retracted and extended positions.

9. An umbrella as claimed in claim 8, wherein said shaft includes an upper end and a midportion, and wherein said upper end of said canopy is slidable relative to said shaft from a raised position adjacent said upper end of said shaft to lowered position adjacent said midportion.

10. An umbrella as claimed in claim 8, further comprising means for moving said canopy relative to said shaft.

11. An umbrella as claimed in claim 9, wherein said moving means includes a flexible member extending up through said shaft, around said upper end of said shaft, back toward said canopy and attached to said canopy.

12. An umbrella as claimed in claim 11, wherein said flexible member is a cord.

13. An umbrella as claimed in claim 11, wherein said shaft includes a pulley at said upper end of said shaft, and wherein said flexible member passes over said pulley.

14. An umbrella as claimed in claim 11, wherein said shaft further includes a lower end, and wherein said flexible member extends out of said shaft adjacent to said lower end.

15. An umbrella as claimed in claim 14, wherein said shaft includes a pulley at said lower end, and wherein said flexible member passes over said pulley.

16. An umbrella as claimed in claim 8, wherein said canopy includes a periphery, and wherein said skirt is mounted to said periphery of said canopy.

17. An umbrella as claimed in claim 8, wherein said moving means includes a plurality of flexible members connected to said skirt.

18. An umbrella as claimed in claim 8, wherein said canopy further includes a plurality of ribs, and wherein said flexible members are positioned at least partially within corresponding ribs.

* * * * *

UNITED STATES PATENT AND TRADEMARK OFFICE

CERTIFICATE OF CORRECTION

PATENT NO. : 5,740,822
DATED : April 21, 1998
INVENTOR(S) : Barry Einck

It is certified that error appears in the above-indentified patent and that said Letters Patent is hereby corrected as shown below:

Column 2, line 13, "Skirt" should be --skirt--.
Column 4, line 64, after "positions" insert --;--.

Signed and Sealed this

Sixteenth Day of June, 1998

*Attest:*

*Attesting Officer*

BRUCE LEHMAN

*Commissioner of Patents and Trademarks*